US008611802B2

(12) United States Patent
Suzuki et al.

(10) Patent No.: US 8,611,802 B2
(45) Date of Patent: Dec. 17, 2013

(54) FIXING DEVICE

(75) Inventors: Noboru Suzuki, Komaki (JP); Kei Ishida, Aichi (JP); Yasushi Fujiwara, Itami (JP); Tsuneo Fujiwara, legal representative, Itami (JP); Etsuko Fujiwara, legal representative, Itami (JP); Yoshihiro Miyauchi, Ama (JP); Tomohiro Kondo, Aichi (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 198 days.

(21) Appl. No.: 13/031,659

(22) Filed: Feb. 22, 2011

(65) Prior Publication Data

US 2011/0211881 A1 Sep. 1, 2011

(30) Foreign Application Priority Data

Feb. 26, 2010 (JP) ..... 2010-042031

(51) Int. Cl.
*G03G 15/20* (2006.01)

(52) U.S. Cl.
USPC ..... 399/329

(58) Field of Classification Search
USPC ..... 399/328
See application file for complete search history.

(56) References Cited

U.S. PATENT DOCUMENTS

| | | | | |
|---|---|---|---|---|
| 6,944,420 | B2 * | 9/2005 | Kanamori et al. | 399/329 |
| 7,242,895 | B2 * | 7/2007 | Inada et al. | 399/328 |
| 2002/0168202 | A1 | 11/2002 | Izawa et al. | |
| 2005/0185994 | A1 | 8/2005 | Inada et al. | |
| 2005/0220509 | A1 * | 10/2005 | Kubochi et al. | 399/329 |
| 2009/0257794 | A1 * | 10/2009 | Kaino et al. | 399/329 |
| 2010/0150621 | A1 * | 6/2010 | Sugaya | 399/328 |

FOREIGN PATENT DOCUMENTS

| | | | |
|---|---|---|---|
| JP | 06-337601 | A | 12/1994 |
| JP | 2002-323821 | | 11/2002 |
| JP | 2004-163464 | * | 6/2004 |
| JP | 2004-163464 | A | 6/2004 |
| JP | 2004163464 | * | 6/2004 |
| JP | 2005-338220 | A | 12/2005 |
| JP | 2006-039184 | * | 2/2006 |
| JP | 2006-039184 | A | 2/2006 |

(Continued)

OTHER PUBLICATIONS

JP 2006039184 Translated.*

(Continued)

*Primary Examiner* — Clayton E Laballe
*Assistant Examiner* — Victor Verbitsky
(74) *Attorney, Agent, or Firm* — Banner & Witcoff, Ltd.

(57) ABSTRACT

A fixing device for fixing a developing agent image to a sheet includes a tubular flexible member, a nip member, a backup member and a restricting member. The tubular flexible member has an inner peripheral surface defining an internal space having the nip member disposed therein and an outer peripheral surface opposite the inner peripheral surface, the tubular flexible member defining an axis extending in an axial direction. The backup member is configured to provide a nip region in cooperation with the nip member for nipping the tubular flexible member between the backup member and the nip member. The restricting member is configured to restrict the tubular flexible member from moving in the axial direction, the restricting member having a base section, and inner and outer guides protruding inward from the base section in the axial direction for guiding the inner peripheral surface and the outer peripheral surface, respectively.

7 Claims, 7 Drawing Sheets

(56) References Cited

FOREIGN PATENT DOCUMENTS

| | | | | |
|---|---|---|---|---|
| JP | 2006039184 | | * | 2/2006 |
| JP | 4035426 | B2 | | 1/2008 |
| JP | 2008-242177 | A | | 10/2008 |

OTHER PUBLICATIONS

JP 2004163464 Translated.*
Co-pending U.S. Appl. No. 13/031,665, filed Feb. 22, 2011.
JP Office Action dated Jan. 24, 2012, in corresponding Application 2010-042038; English Translation.
JP Office Action dated Jan. 24, 2012, in corresponding Application 2010-042031; English Translation.
Final Office Action received in U.S. Appl. No. 13/031,665 mailed May 30, 2013.
CN Office Action dtd Feb. 8, 2013, CN App. 201110045195.8, English translation.
CN Office Action dtd Jan. 31, 2013, CN App. 201110045173.1, English translation.

* cited by examiner

FIXING DEVICE

CROSS REFERENCE TO RELATED APPLICATION

This application claims priorities from Japanese Patent Application No. 2010-042031 filed Feb. 26, 2010. The entire content of the priority application is incorporated herein by reference. Further, the present application closely relates to a co-pending U.S. patent application (based on Japanese patent application No. 2010-042038 filed Feb. 26, 2010).

TECHNICAL FIELD

The present invention relates to a fixing device that thermally fixes a transferred developing agent image to a sheet.

BACKGROUND

A well-known thermal fixing device includes an endless fixing (fusing) film, a heater disposed in an internal space of the fixing film, a pressure roller that nips the fixing film together with the heater, and a pair of guide members that guides an outer circumferential surface of the fixing film. The guide members are disposed respectively on both widthwise ends of the fixing film. Developer on a recording sheet is thermally fixed thereon while the recording sheet is conveyed between the fixing film and the pressure roller (a nip region). Each guide member has a cylindrical shape whose inner circumferential surface serves to guide the outer circumferential surface of the fixing film.

Another conventional fixing device is provided with a pair of guide members having outer and inner guide portions for guiding an endless fixing film. The outer guide portion serves to guide an outer circumferential surface of the fixing film, while the inner guide portion serves to guide an inner circumferential surface of the fixing film. In the fixing device, the outer and inner guide portions are formed to have a protruding length identical to each other.

SUMMARY

However, upon occurrence of a paper jam, if a user pulls a jammed sheet out of the nip region, the fixing film may be forced to move along with the user's pulling out of the jammed sheet. In this case, the present inventors have found that, if the outer guide portion and the inner guide portion have the same protruding length as each other (i.e., tip ends of both guide portions are in coincident with each other with respect to a widthwise direction of the fixing film), the fixing film may bend at the tip ends of the inner and outer guide portions.

In view of the foregoing, it is an object of the present invention to provide a fixing device capable of preventing a fusing film from bending at the time of user's clearance of a paper jam.

In order to attain the above and other objects, there is provided a fixing device for thermally fixing a developing agent image to a sheet. The fixing device includes a tubular flexible member, a nip member, a backup member and a restricting member. The tubular flexible member has an inner peripheral surface defining an internal space and an outer peripheral surface opposite to the inner peripheral surface, the tubular flexible member defining an axis extending in an axial direction. The nip member is disposed within the internal space. The backup member is configured to provide a nip region in cooperation with the nip member for nipping the tubular flexible member between the backup member and the nip member. The restricting member is configured to restrict the tubular flexible member from moving in the axial direction, the restricting member having a base section, an inner guide protruding inward from the base section in the axial direction for guiding the inner peripheral surface and an outer guide protruding inward from the base section in the axial direction for guiding the outer peripheral surface, the inner guide having a portion whose protruding end is positioned inward of a protruding end of the outer guide in the axial direction.

DETAILED DESCRIPTION

First, a general configuration of a laser printer 1 (as an image forming device) in which a fixing device 100 according to an embodiment of the present invention is disposed will be described with reference to FIG. 1. A general structure of the laser printer 1 will firstly be described. Then, a detailed structure of the fixing device 100 will be described.

Throughout the specification, the terms "above", "below", "right", "left", "front", "rear" and the like will be used assuming that the laser printer 1 is disposed in an orientation in which it is intended to be used. More specifically, in FIG. 1, a right side, a left side, a near side and a far side are referred to as a front side, a rear side, a left side and a right side, respectively.

Figure 1:
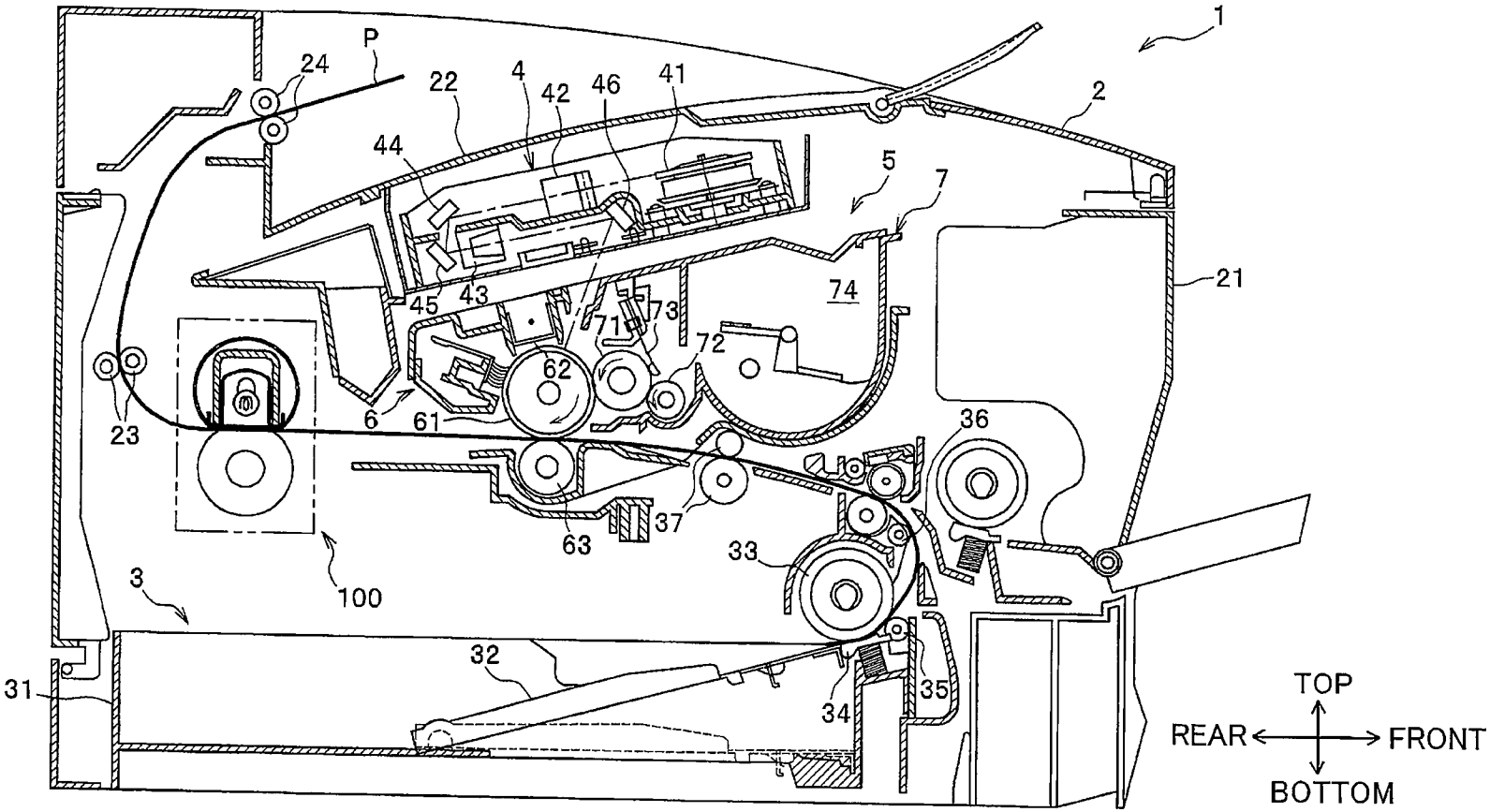
FIG. 1 is a schematic cross-sectional view illustrating a general configuration of a laser printer provided with a fixing device according to an embodiment of the present invention.

As shown in FIG. 1, the laser printer 1 includes a main frame 2 provided with a movable front cover 21. Within the main frame 2, a sheet supply unit 3 for supplying a sheet P, an exposure unit 4, a process cartridge 5 for transferring a toner image (developing agent image) on the sheet P, and the fixing device 100 for thermally fixing the toner image onto the sheet P are provided.

The sheet supply unit 3 is disposed at a lower portion of the main frame 2. The sheet supply unit 3 includes a sheet supply tray 31 for accommodating the sheet P, a lifter plate 32 for lifting up a front side of the sheet P, a sheet supply roller 33, a sheet supply pad 34, paper dust removing rollers 35, 36, and a pair of registration rollers 37. Each sheet P accommodated in the sheet supply tray 31 is directed upward to the sheet supply roller 33 by the lifter plate 32, separated by the sheet supply roller 33 and the sheet supply pad 34, and conveyed toward the process cartridge 5 via the paper dust removing rollers 35, 36, and the pair of registration rollers 37.

The exposure unit 4 is disposed at an upper portion of the main frame 2. The exposure unit 4 includes a laser emission unit (not shown), a polygon mirror 41, lenses 42, 43, and reflection mirrors 44, 45, 46. In the exposure unit 4, the laser emission unit emits a laser beam (indicated by a chain line in FIG. 1) based on image data so that the laser beam is reflected by or passes through the polygon mirror 41, the lens 42, the reflection mirrors 44, 45, the lens 43, and the reflection mirror 46 in this order. A surface of a photosensitive drum 61 is subjected to high speed scan of the laser beam.

The process cartridge 5 is disposed below the exposure unit 4. The process cartridge 5 is detachably loadable in the main frame 2 through a front opening defined when the front cover 21 of the main frame 2 is opened. The process cartridge 5 includes a drum unit 6 and a developing unit 7.

The drum unit 6 includes the photosensitive drum 61, a charger 62, and a transfer roller 63. The developing unit 7 is detachably mounted on the drum unit 6. The developing unit 7 includes a developing roller 71, a toner supply roller 72, a thickness-regulation blade 73, and a toner accommodating portion 74 in which toner (developing agent) is accommodated.

In the process cartridge 5, after the surface of the photosensitive drum 61 has been uniformly charged by the charger 62, the surface is exposed to high speed scan of the laser beam from the exposure unit 4. An electrostatic latent image based on the image data is thereby formed on the surface of the photosensitive drum 61. The toner accommodated in the toner accommodating portion 74 is supplied to the developing roller 71 via the toner supply roller 72. The toner then enters between the developing roller 71 and the thickness-regulation blade 73 to be carried on the developing roller 71 as a thin layer having a uniform thickness.

The toner borne on the developing roller 71 is supplied to the electrostatic latent image formed on the photosensitive drum 61. Hence, a visible toner image corresponding to the electrostatic latent image is formed on the photosensitive drum 61. Then, the sheet P is conveyed between the photosensitive drum 61 and the transfer roller 63, so that the toner image formed on the photosensitive drum 61 is transferred onto the sheet P.

The fixing device 100 is disposed rearward of the process cartridge 5. The toner image (toner) transferred onto the sheet P is thermally fixed on the sheet P while the sheet P passes through the fixing device 100. The sheet P on which the toner image is thermally fixed is then conveyed by conveying rollers 23, 24 to be discharged onto a discharge tray 22 formed on an upper surface of the main frame 2.

Next, a detailed structure of the fixing device 100 according to the embodiment of the present invention will be described with reference to FIGS. 2 through 4.

Figure 2:
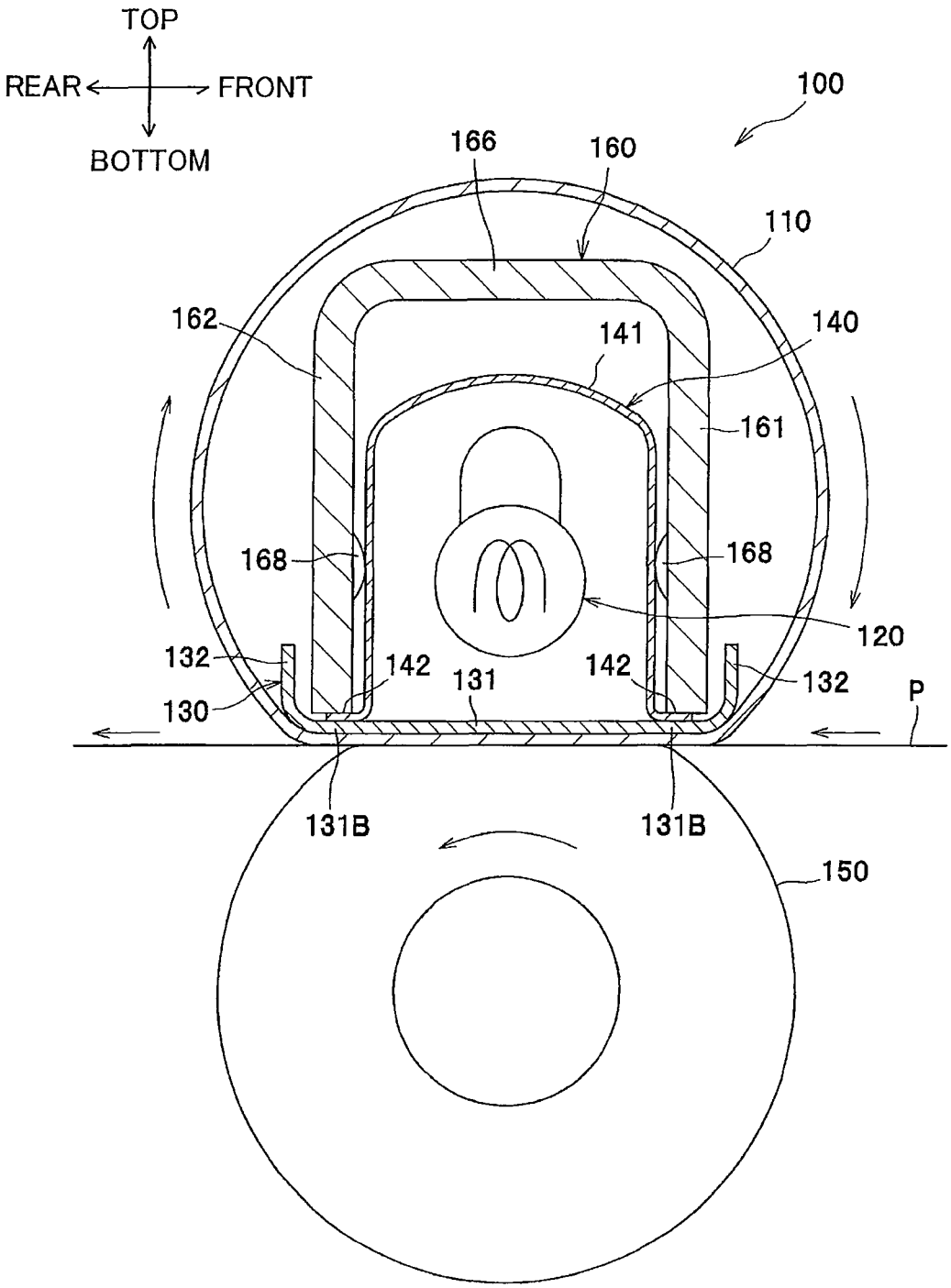
FIG. 2 is a schematic cross-sectional view illustrating a general configuration of the fixing device according to the embodiment.

As shown in FIG. 2, the fixing device 100 includes a flexible tubular fusing member such as a tube or film 110, a halogen lamp 120 as a heater, a nip plate 130 as a nip member, a reflection plate 140 as a reflection member, a pressure roller 150 as a backup member and a stay 160.

In the following description, a direction in which the sheet P is fed (a frontward/rearward direction) will be simply referred to as a sheet feeding direction; a widthwise direction of the sheet P (a lateral or rightward/leftward direction) will be simply referred to as a widthwise direction.

The fusing film 110 is of an endless film (of a tubular configuration) having heat resistivity and flexibility. The fusing film 110 has an internal space within which the halogen lamp 120, the nip plate 130, the reflection plate 140 and the stay 160 are disposed. The fusing film 110 has widthwise end portions that are guided by guide members 170 (described later) so that the fusing film 110 is circularly movable. The fusing film 110 may be a metal film or a resin film. Alternatively, the fusing film 110 may be a film whose outer circumferential surface is coated with a rubber.

The halogen lamp 120 is a heater to heat the nip plate 130 to heat the fusing film 110 for heating toner on the sheet P. The halogen lamp 120 is positioned at the internal space of the fusing film 110 such that the halogen lamp 120 is spaced away from an inner surface of the nip plate 130 by a predetermined distance. Each widthwise end of the halogen lamp 120 is provided with a terminal 121 for electrically connecting the halogen lamp 120 to a power source (not shown) provided in the main frame 2 (FIG. 3).

The nip plate 130 is adapted for receiving pressure from the pressure roller 150 and for transmitting radiation heat from the halogen lamp 120 to the toner on the sheet P through the fusing film 110. To this effect, the nip plate 130 is stationarily positioned such that an inner circumferential surface of the fusing film 110 is slidably movable with a lower surface of the nip plate 130 through grease. The nip plate 130 may be in direct contact with the lower surface of the fusing film 110, or may be in contact with the same via a coating layer.

The nip plate 130 is made from a material such as aluminum having a thermal conductivity higher than that of the stay 160 (described later) made from a steel. More specifically, for fabricating the nip plate 130, an aluminum plate is bent into a U-shape to provide a base portion 131 and two folded portions 132.

The base portion 131 is flat and extends in the sheet feeding direction. The base portion 131 has an inner (upper) surface painted with a black color or provided with a heat absorbing member so as to efficiently absorb radiant heat from the halogen lamp 120. The base portion 131 has front and rear end portions 131B (see FIG. 2). The folded portions 132 extend upward respectively from the front and rear end portions 131B of the base portion 131.

Figure 3:
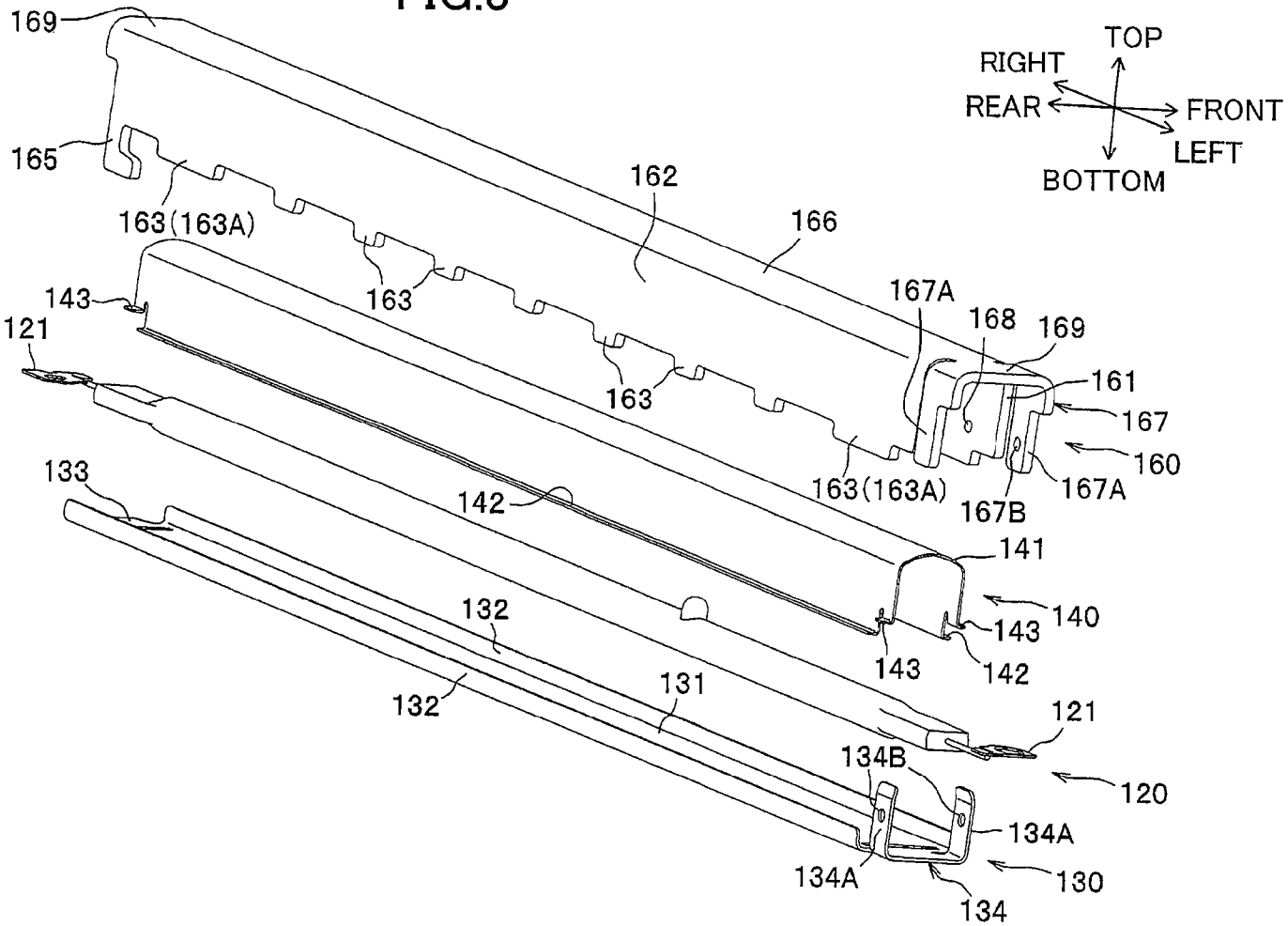
FIG. 3 is an exploded perspective view of the fixing device according to the embodiment, the fixing device including a halogen lamp, a nip plate, a reflection plate and a stay.

As shown in FIG. 3, the base portion 131 has a right end portion provided with an insertion portion 133 extending flat, and a left end portion provided with an engagement portion 134. The engagement portion 134 has a U-shaped configuration as viewed from a left side and includes a pair of side wall portions 134A extending upward. Each side wall portion 134A is formed with an engagement hole 134B.

The reflection plate 140 is adapted to reflect radiant heat radiating from the halogen lamp 120 toward the nip plate 130 (toward the inner surface of the base portion 131). As shown in FIG. 2, the reflection plate 140 is positioned within the fusing film 110 and surrounds the halogen lamp 120, with a predetermined distance therefrom. Thus, heat from the halogen lamp 120 can be efficiently concentrated onto the nip plate 130 to promptly heat the nip plate 130 and the fusing film 110.

The reflection plate 140 is configured to have a U-shaped cross-section and is made from a material such as aluminum having high reflection ratio regarding infrared ray and far infrared ray. The reflection plate 140 has a U-shaped reflection portion 141 and a flange portion 142 extending from each end portion of the reflection portion 141 in the sheet feeding direction. A mirror surface finishing is available on the surface of the aluminum reflection plate 140 for specular reflection in order to enhance heat reflection ratio.

As shown in FIG. 3, two engagement sections 143 are formed at each widthwise end of the reflection plate 140 (only three of four engagement sections 143 are shown in FIG. 3). Each engagement section 143 is positioned higher than the flange portion 142.

The pressure roller 150 is formed of an elastically deformable material. The pressure roller 150 is positioned below the nip plate 130. In an elastically deformed state, the pressure roller 150 nips the fusing film 110 in cooperation with the nip plate 130 to provide a nip region for nipping the sheet P between the pressure roller 150 and the fusing film 110. To provide the nip region, a biasing member, such as a coil spring, may be provided to bias the pressure roller 150 toward the nip plate 130 or vice versa.

The pressure roller 150 is rotationally driven by a drive motor (not shown) disposed in the main frame 2. By the rotation of the pressure roller 150, the fusing film 110 is circularly moved along the nip plate 130 because of the friction force generated between the pressure roller 150 and the sheet P, and between the sheet P and the fusing film 110. The toner image on the sheet P can be thermally fixed thereon by heat and pressure applied while the sheet P passes between the pressure roller 150 and the fusing film 110 (the nip region).

The stay 160 is adapted to support the front and rear end portions 131B of the nip plate 130 via the flange portions 142 of the reflection plate 140 for maintaining rigidity of the nip plate 130. The stay 160 has a U-shape configuration in conformity with an outer profile of the reflection portion 141 for covering the reflection plate 140. For fabricating the stay 160, a highly rigid member such as a steel plate is folded into U-shape to provide a top wall 166, a front wall 161 and a rear wall 162.

As shown in FIG. 3, each of the front wall 161 and the rear wall 162 has a lower end portion 163 formed with comb-like contact portions 163.

As a result of assembly of the nip plate 130 together with the reflection plate 140 and the stay 160, the comb-like contact portions 163 are nipped between the right and left engagement sections 143. That is, the right engagement section 143 is in contact with the rightmost contact portion 163A, and the left engagement section 143 is in contact with the leftmost contact portion 163A. As a result, displacement of the reflection plate 140 in the widthwise direction due to vibration caused by operation of the fixing device 100 can be restrained by the engagement between the engagement sections 143 and the comb-like contact portions 163A.

The front and rear walls 161, 162 have right end portions formed with substantially L-shaped engagement legs 165 each extending downward and then leftward. The insertion portion 133 of the nip plate 130 is insertable into a space between the confronting engagement legs 165 and 165. Further, each end portion 131B of the base portion 131 is abuttable on each engagement leg 165 as a result of the insertion.

The top wall 166 has a left end portion provided with a U-shaped retainer 167. The retainer 167 has a pair of retaining walls 167A whose inner surfaces are provided with engagement bosses 167B each being engageable with each engagement hole 134B.

As shown in FIGS. 2 and 3, each of the front wall 161 and the rear wall 162 has widthwise end portions whose inner surfaces are respectively provided with two abutment bosses 168 protruding inward in abutment with the reflection portion 141 in the sheet feeding direction. Therefore, displacement of the reflection plate 140 in the sheet feeding direction due to vibration caused by operation of the fixing device 100 can be restrained because of the abutment of the reflection portion 141 with the bosses 168.

Assembling procedure of the reflection plate 140 and the nip plate 130 to the stay 160 will now be described. First, the reflection plate 140 is temporarily assembled to the stay 160 by the abutment of an outer surface of the reflection portion 141 on the abutment bosses 168. At this time, the engagement sections 143 are in contact with the widthwise endmost contact portions 163A.

Figure 4:
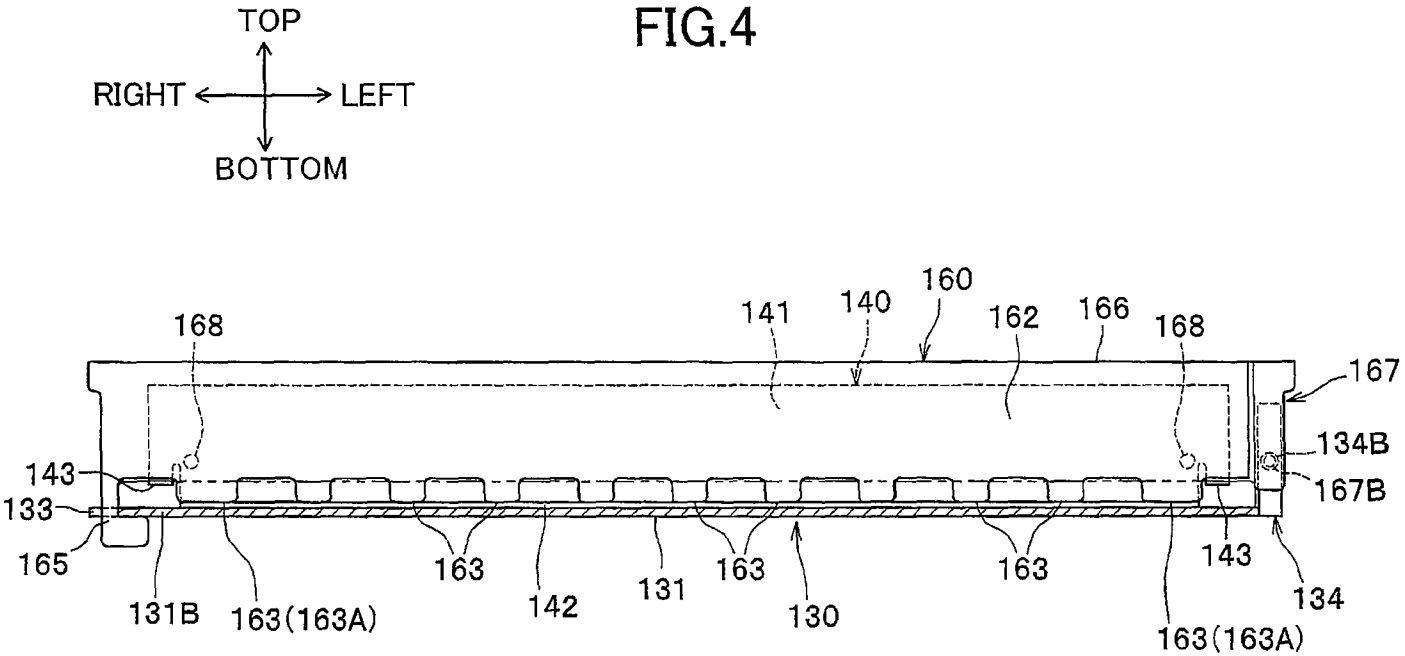
FIG. 4 is a view illustrating a state in which the nip plate, reflection plate and the stay are assembled and viewed from a rear side.

Then, as shown in FIG. 4, the insertion portion 131C of the nip plate 130 is inserted between the confronting engagement legs 165, so that the base portion 131 (both ends portions 131B) can be brought into engagement with the engagement legs 165. Thereafter, the engagement bosses 167B of the retainer 167 are engaged with the corresponding engagement holes 134B of the engagement portion 134. By this engagement, each flange portion 142 is sandwiched between the nip plate 130 (each end portion 131B) and the stay 160. Thus, the nip plate 130 and the reflection plate 140 are held to the stay 160.

Thus, vertical displacement of the reflection plate 140 due to vibration caused by operation of the fixing device 100 can be restrained, since the flange portions 142 are held between the nip plate 130 and the stay 160. Therefore, position of the reflection plate 140 relative to the nip plate 130 can be fixed and rigidity of the reflection plate 140 can be maintained.

Figure 5:
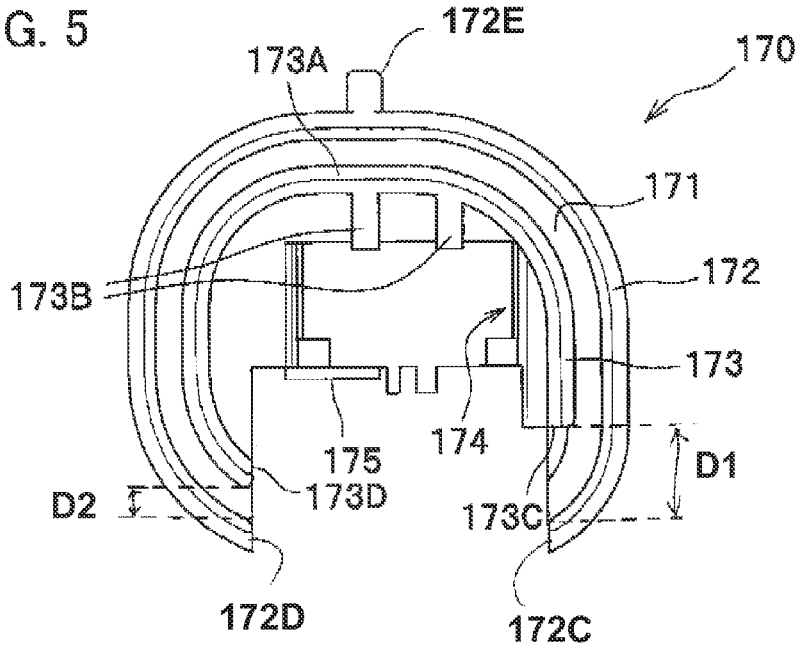
FIG. 5 is a view illustrating an inner side of a guide member of the fixing device according to the embodiment.
Figure 6:
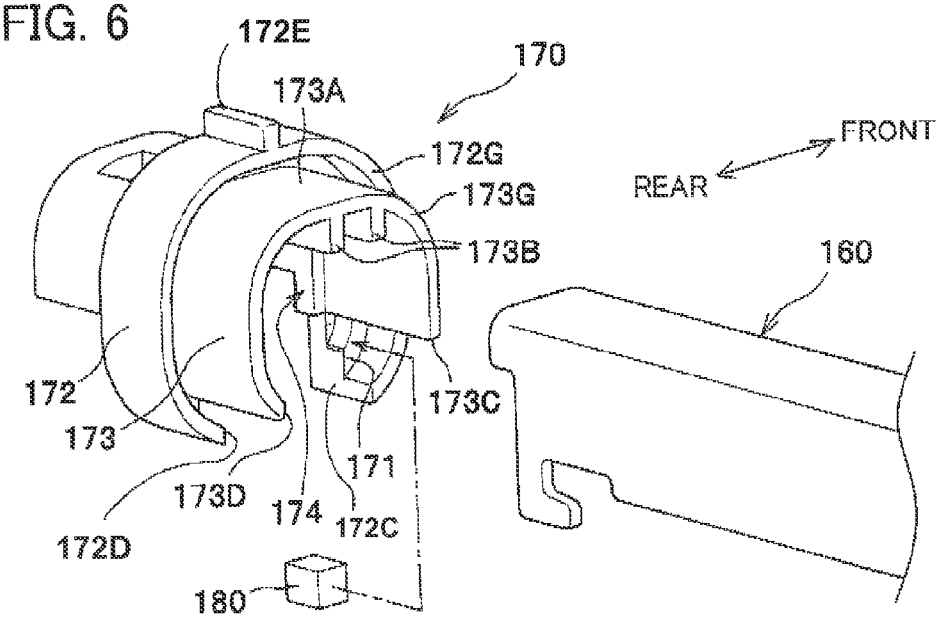
FIG. 6 is an exploded perspective view of the guide member and the stay according to the embodiment.

The stay 160 to which the reflection plate 140 and the nip plate 130 are assembled is then fixed to the pair of guide members 170 along with the halogen lamp 120. The stay 160 holding the nip plate 130 and the reflection plate 140, and the halogen lamp 120 are directly fixed to the pair of guide members 170 (one is shown in FIGS. 5 and 6). That is, the guide members 170 integrally support the nip plate 130, the reflection plate 140, the stay 160 and the halogen lamp 120. The guide members are fixed to a main casing (not shown) of the fixing device 100. Thus, the fusing film 110, the halogen lamp 120, the nip plate 130, the reflection plate 140, and the stay 160 are held to the main casing of the fixing device 100.

The guide member 170 is formed of an electrically and thermally insulative material, such as a resin. The pair of the guide members 170 are disposed at both widthwise end portions of the fusing film 110 for guiding circular movement of the fusing film 110. More specifically, the guide members 170 slidingly contact the widthwise end portions of the fusing film 110 (the inner circumferential surface and an outer circumferential surface of the fusing film 110) to prevent the fusing film 110 from moving in the widthwise direction. In other words, the guide member 170 serves as a restricting member that restricts movement of the fusing film 110 in the widthwise direction Now a detailed configuration of the guide member 170 according to the present embodiment will be described with reference to FIGS. 5 and 6. As shown in FIGS. 5 and 6, each guide member 170 includes a restricting surface 171, an outer guide 172, an inner guide 173 and a supporting recess 174.

The restricting surface 171 serves to restrict movement of the fusing film 110 with respect to the widthwise direction. The restricting surface 171 corresponds to a base section of the restricting member.

The outer guide 172 is a rib for guiding the outer circumferential surface of the fusing film 110. The outer guide 172 has a substantially C shape whose opening faces downward. The outer guide 172 protrudes inward from the restricting surface 171 in the widthwise direction. The outer guide 172 is positioned radially outward of the fusing film 110 so as to prevent the fusing film 110 from deforming radially outward. The opening of the outer guide 172 serves as a space for accommodating the stay 160 inserted into the supporting recess 174.

The inner guide 173 is a rib for guiding the inner circumferential surface of the fusing film 110. The inner guide 173 has a substantially C shape whose opening is oriented downward. The inner guide 173 protrudes inward from the restricting surface 171 in the widthwise direction. The inner guide 173 is positioned radially inward of the fusing film 110 so as to prevent the fusing film 110 from deforming radially inward. The opening of the outer guide 172 serves as a space for accommodating the stay 160 inserted into the supporting recess 174. The outer guide 172 has an upper end portion from which a protruding portion 172E protrudes upward.

The inner guide 173 has a protruding length greater than that of the outer guide 172 in the widthwise direction. Specifically, the inner guide 173 has a tip end portion 173G that is positioned inward of a tip end portion 172G of the outer guide 172 in the widthwise direction, as illustrated in FIG. 6. In other words, with respect to the widthwise direction, the tip end portion 172G of the outer guide 172 is located at a position different from a position at which the tip end portion 173G of the inner guide 173 is positioned.

If the outer guide 172 and the inner guide 173 are formed to have a protruding length identical to each other, the fusing film 110 could easily bend at the tip end portion 172G (or the tip end portion 173G) at the time of user's operation to address a paper jam. However, with the above-described configuration, even if the fusing film 110 is pulled to move in conjunction with user's removal of the jammed sheet P, the fusing film 110 is hard to bend either at the tip end portion 172G or the tip end portion 173G since both end portions 172G and 173G do not coincide with each other in the widthwise direction.

Further, the protruding length of the inner guide 173 in the widthwise direction is sufficiently large to support (receive) the fusing film 110. Therefore, the fusing film 110 does not bend easily at the tip end portion 173G of the inner guide 173.

The inner guide 173 has an upper portion 173A on which two supporting sections 173B are integrally formed. The supporting section 173B is a rib extending downward (toward the stay 160) from the upper portion 173A, and spans across an entire width of the upper portion 173A in the widthwise direction. The supporting sections 173B are adapted to support the top wall 166 of the stay 160. Two supporting sections 173B are provided in opposition to each other in the sheet feeding direction so that the stay 160 can be supported in a balanced manner with respect to the frontward/rearward direction.

As described above, the supporting sections 173B are formed integrally with the inner guide 173 such that the supporting sections 173B span the entire width of the inner guide 173 whose protruding length is greater than that of the outer guide 172. Therefore, the supporting sections 173B can support the stay 160 with a small distance kept therebetween and prevent the stay 160 from being deformed.

Further, the inner guide 173 also has a front end portion 173C and a rear end portion 173D. The front end portion 173C is formed to be positioned higher than the rear end portion 173D when seen in the widthwise direction, as shown in FIGS. 5 and 6. In other words, the inner guide 173 has a substantially C shape whose frontward bottom end portion is cut out therefrom. Thus, a space is formed below the front end portion 173C.

More specifically, referring to FIG. 5, the outer guide 172 has a front end portion 172C and a rear end portion 172D (upstream end portion and downstream end portion in the sheet feeding direction). A distance D1 between the rear end portion 172D and the rear end portion 173D. Due to the distance D1 defined between the front end portion 172C of the outer guide 172 and the front end portion 173C of the inner guide 173, the space is provided. The space formed below the front end portion 173C is used for accommodating therewithin a temperature sensor 180 for detecting a temperature of the nip plate 130, as shown in FIG. 6. That is, the space below the front end portion 173C (corresponding to the portion cut out from the inner guide 173) serves to prevent interference between the inner guide 173 and the temperature sensor 180.

The supporting recess 174 opens inward in the widthwise direction and has an opening facing downward for enabling the stay 160 to be accommodated within the guide member 170 in conjunction with the openings formed in the outer guide 172 and the inner guide 173. Each widthwise end of the stay 160 is inserted into the supporting recess 174 so that the supporting recess 174 can support the front wall 161 and the rear wall 162 of the inserted stay 160. The supporting recess 174 corresponds to a supporting section of the inner guide 173. Further, the inner guide 173 is formed with a holding portion 175 at a position outward of the supporting recess 174 in the widthwise direction, as shown in FIG. 5. The terminal 121 of the halogen lamp 120 (see FIG. 3) is fixed to the holding portion 175.

As in the present embodiment, in such a configuration that the nip plate 130 and the guide member 170 are integrally moved to press the nip plate 130 against the pressure roller 150, the terminal 121 may be electrically connected to the power source (not shown) of the main frame 2 via a flexible wire.

With the above-described configuration, since the tip end portion 173G of the inner guide 173 is positioned inward of the tip end portion 172G of the outer guide 172 in the widthwise direction, the fusing film 110 is prevented from bending when the user pulls the fusing film 110 together with the jammed sheet P upon occurrence of a paper jam. In other words, since the fusing film 110 has two different points at which the fusing film 110 may bend with respect to the widthwise direction, the fusing film 110 is suppressed from bending easily.

Further, the substantially C-shaped inner guide 173 is formed with an outer surface around which the inner circumferential surface of the fusing film 110 is guided. The outer surface of the inner guide 173 can provide an area wide enough to suppress the fusing film 110 from bending. In this sense as well, the fusing film 110 is hard to bend at the time of user's addressing a paper jam.

The fusing film 110 is a flexible tubular member and therefore has a tendency to deform inward. However, with provision of the inner guide 173 having the protruding length larger than that of the outer guide 172 in the widthwise direction, the widthwise end portions of the fusing film 110 are respectively allowed to have a wider area to be supported by the inner guide 173, and therefore inward deformation of the fusing film 110 can be suppressed. Bending or distortion of the fusing film 110 is therefore also suppressed.

Further, the supporting sections 173B for supporting the stay 160 are integrally formed on the inner guide 173 protruding inward of the outer guide 172 in the widthwise direction. With this configuration, the stay 160 is allowed to be supported by the supporting sections 173B with a short distance kept therebetween, thereby preventing the stay 160 from being distorted or deforming.

Further, the inner guide 173 is provided with the space within which the temperature sensor 180 can be disposed. Therefore, the interference between the inner guide 173 and the temperature sensor 180 can be prevented so that the temperature sensor 180 can be positioned suitably within the space.

Various modifications are conceivable.

For example, in the above-described embodiment, protruding length of the entire portion of the inner guide 173 is greater than that of the outer guide 172. However, protruding length of the partial inner guide 173 can be greater than that of the outer guide 172. More specifically, the inner guide 173 has an upstream portion and a downstream portion in the sheet feeding direction, and at least one of the upstream portion and the downstream portion can have a protruding length greater than that of the outer guide 172. As long as the inner guide 173 has a tip end portion positioned inward of the tip end portion 172G of the outer guide 172 in the widthwise direction, other portions of the inner guide 173 may be positioned outward of the tip end portion 172G of the outer guide 172 in the widthwise direction.

In other words, the present invention encompasses such a case that the positional relationship between the tip end portion 172G of the outer guide 172 and the tip end portion 173G of the inner guide 173 (i.e., the tip end portion 173G is positioned inward of the tip end portion 172G in the widthwise direction) is realized at least partially when viewed in the sheet feeding direction (in a direction in which the fusing film 110 circularly moves). Further, the above positional relationship may be reversed at any other portion of the guide member 170 where this positional relationship is not realized.

Figure 7:
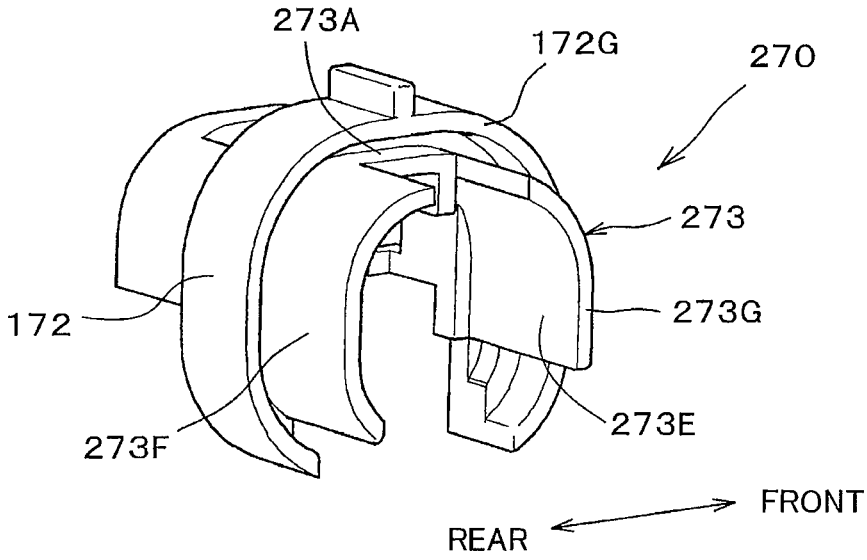
FIG. 7 is a perspective view of a guide member according to a first modification of the present invention.

As an illustrative example, a guide member 270 according to a first modification of the embodiment is shown in FIG. 7. In the following description, like parts and components are designated by the same reference numerals as those of the embodiment to avoid duplicating description.

The guide member 270 includes the outer guide 172 and an inner guide 273. The inner guide 273 has an upper portion 273A whose portion is cut out from the inner guide 273 such that the upper portion 273A has a protruding length smaller than that of the outer guide 172 to provide a front portion 273E (a portion positioned upstream in the sheet feeding direction) and a rear portion 273F (a portion positioned downstream in the sheet feeding direction). The front portion 273E and the rear portion 273F have a protruding length greater than that of the outer guide 172, as shown in FIG. 7. That is, each of the front portion 273E and the rear portion 273F has a tip end 273G that is positioned inward of the tip end portion 172G of the outer guide 172 in the widthwise direction.

With this configuration, upon occurrence of a paper jam, even if the fusing film 110 is pulled frontward or rearward in the sheet feeding direction to be moved in accordance with user's removal of the jammed sheet P, either one of the front portion 273E and the rear portion 273F can stably support the widthwise end portions of the fusing film 110, thereby suppressing the fusing film 110 from bending or being distorted as in the embodiment.

Further, compared to the substantially C-shaped inner guide 173 of the above-described embodiment, the upper portion 273A of the inner guide 273 has a protruding length smaller than that of the upper portion 173A. Therefore, the guide member 270 can realize a reduced weight and a lower friction to be generated between the inner guide 173 and the fusing film 110.

Figure 8:
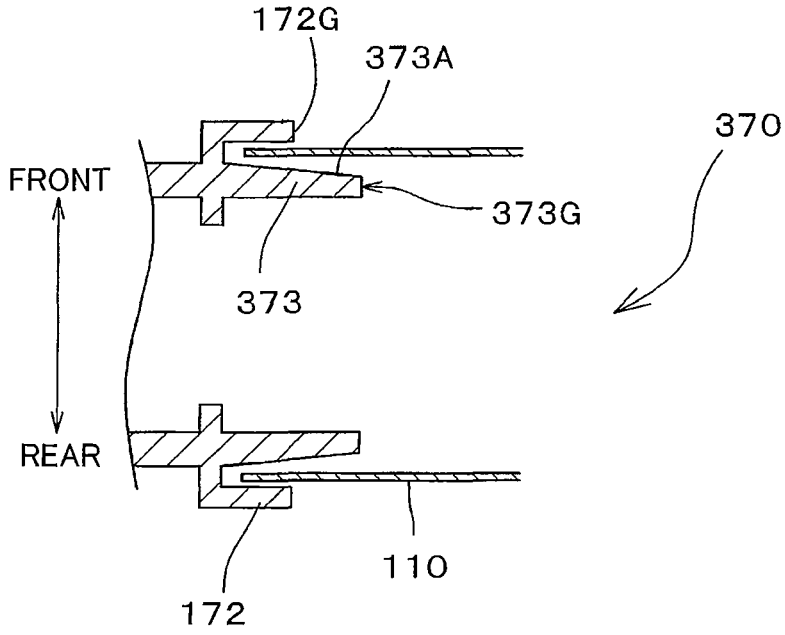
FIG. 8 is a cross-sectional view of a guide member according to a second modification of the present invention.

Next, a guide member 370 according to a second modification of the embodiment will be described with reference to FIG. 8.

The guide member 370 has the outer guide 172 and an inner guide 373. The inner guide 373 has a tip end 373G that is positioned inward of the tip end portion 172G in the widthwise direction, as in the depicted embodiment. The inner guide 373 has an outer surface 373A serving as a guide surface to guide the inner circumferential surface of the fusing film 110. The guide surface 373A is formed to slope radially inward of the fusing film 110 as the guide surface 373A extends inward in the widthwise direction. In other words, the inner guide 373 is formed in a tapered shape.

With this configuration, upon occurrence of a paper jam, even if the fusing film 110 is pulled frontward or rearward in the sheet feeding direction to be moved frontward or rearward in accordance with user's removal of the jammed sheet P, the fusing film 110 is moved along the slope of the guide surface 373A to gently deform into an arcuate shape. That is, the fusing film 110 does not bend but exhibits a modest deformation. Therefore, once the jammed sheet P has been taken out of the nip region, the fusing film 110 can move back into a gap between the outer guide 172 and the inner guide 373 due to resilient force of the fusing film 110.

Further, in the depicted embodiment, the stay 160 and the reflection plate 140 can be dispensed with. Further, an infrared ray heater or a carbon heater is available instead of the halogen lamp 120.

Further, instead of the nip plate 130 having a plate shape, a member having a certain thickness may be employed. For example, a ceramic heater is available.

In the depicted embodiment, the pressure roller 150 is employed as a backup member. However, a belt like pressure member is also available.

Further, the sheet P can be an OHP sheet instead of a plain paper and a postcard.

Further, in the depicted embodiment, the present invention is applied to the monochromatic laser printer 1 as an example of image forming devices. However, a color laser printer, an LED printer, a copying machine, and a multifunction device are also available.

While the invention has been described in detail with reference to the embodiments thereof, it would be apparent to those skilled in the art that various changes and modifications may be made therein without departing from the spirit of the invention.

What is claimed is:

1. A fixing device for thermally fixing a developing agent image to a sheet comprising:

a tubular flexible member having an inner peripheral surface defining an internal space and an outer peripheral surface opposite to the inner peripheral surface, the tubular flexible member defining an axis extending in an axial direction;

a nip member disposed within the internal space;

a temperature sensor configured to detect a temperature of the nip member;

a backup member configured to provide a nip region in cooperation with the nip member for nipping the tubular flexible member between the backup member and the nip member; and a restricting member configured to restrict the tubular flexible member from moving in the axial direction, the restricting member having a base section, an inner guide protruding inward from the base section in the axial direction for guiding the inner peripheral surface and an outer guide protruding inward from the base section in the axial direction for guiding the outer peripheral surface, the inner guide having a portion whose protruding end is positioned inward of a protruding end of the outer guide in the axial direction, wherein the sheet is fed in a sheet conveying direction;

wherein the inner guide has a first upstream portion located upstream and a first downstream portion located downstream in the sheet conveying direction, the outer guide having a second upstream portion located upstream and a second downstream portion located downstream in the sheet conveying direction, the first upstream portion and the second upstream portion defining a distance therebetween larger than a distance defined between the first downstream portion and the second downstream portion; and wherein the temperature sensor is disposed between the first upstream portion and the second upstream portion.

2. The fixing device as claimed in claim 1, wherein the inner guide has a first portion at least one of the first upstream portion and the first downstream portion of the inner guide having the protruding end positioned inward of the protruding end of the outer guide in the axial direction.

3. The fixing device as claimed in claim 1, wherein the inner guide has a guide surface along which the inner peripheral surface is guided, the guide surface sloping radially inward of the inner peripheral surface as the guide surface extends inward in the axial direction.

4. The fixing device as claimed in claim 1, further comprising a stay configured to support the nip member, the inner guide being integrally formed with a supporting section to which the stay is supported.

5. The fixing device as claimed in claim 1, wherein the tubular flexible member has an end face in the axial direction, the end face being abuttable on the base section.

6. The fixing device as claimed in claim 1, further comprising a stay configured to support the nip member, the inner guide including a rib protruding toward the stay.

7. The fixing device as claimed in claim 1, wherein the outer guide further includes a portion protruding away from the inner guide.

* * * * *